US005816457A

United States Patent [19]

Croft

[11] Patent Number: 5,816,457

[45] Date of Patent: Oct. 6, 1998

[54] HYDRATION SYSTEM

[75] Inventor: Joseph J. Croft, Temecula, Calif.

[73] Assignee: Bianchi International, Temecula, Calif.

[21] Appl. No.: 691,953

[22] Filed: Aug. 5, 1996

Related U.S. Application Data

[60] Provisional application No. 60/002,221 Aug. 11, 1995.

[51] Int. Cl. [6] ..... A45F 3/16

[52] U.S. Cl. ..... 224/148.2; 224/148.4; 251/342

[58] Field of Search ..... 224/148.1–148.6; 251/342; 137/845

[56] References Cited

U.S. PATENT DOCUMENTS

| | | | |
|---|---|---|---|
| 4,090,650 | 5/1978 | Gotta . | |
| 4,139,130 | 2/1979 | Glusker et al. . | |
| 4,176,772 | 12/1979 | Danon . | |
| 4,189,075 | 2/1980 | Hall . | |
| 4,193,518 | 3/1980 | Holmes | 224/148.2 X |
| 4,265,381 | 5/1981 | Muscatell . | |
| 4,449,654 | 5/1984 | Cappis . | |
| 4,852,781 | 8/1989 | Shurnick et al. | 224/148.6 |
| 4,948,023 | 8/1990 | Tripp | 224/148.5 X |
| 5,085,349 | 2/1992 | Fawcett | 224/148.6 X |
| 5,427,290 | 6/1995 | Thatcher | 224/148.2 |
| 5,601,207 | 2/1997 | Paczonay | 251/342 X |

FOREIGN PATENT DOCUMENTS

| | | | |
|---|---|---|---|
| 628167 | 3/1936 | Germany | 251/342 |

*Primary Examiner*—Renee S. Luebke
*Attorney, Agent, or Firm*—Wagner, Middlebrook & Kimbell

[57] ABSTRACT

A hydration system for backpackers or other athletes including a bladder, a filling opening, an enclosing cover and filling opening, a flexible line and a deformable valve to be held in the user's mouth. The cover is of smaller volume than the bladder to protect the bladder from bursting upon overfilling. The valve is operated by pressure in the mouth, usually by the user's jaw and teeth to open a slit and allow potable liquid to flow from the bladder through the line and into the flexible valve for the user's consumption. The slit is located in the side wall of a membrane having a reverse fold whereby pressure from the bladder, in the absence of user applied valve deforming pressure tends to close rather than open the slit. The line includes a quick disconnect fitting to allow the filing of the bladder from the line as well as from its own filler opening. The inline fitting also allows the insertion of other appliances such as inline filter, a "Y" connection to a second person's line and valve, a mister or shower head. The filling opening of the bladder includes a swivel elbow and seal to allow full 360° swiveling to any desired direction position and effective sealing when tightened.

8 Claims, 3 Drawing Sheets

FIG. 5
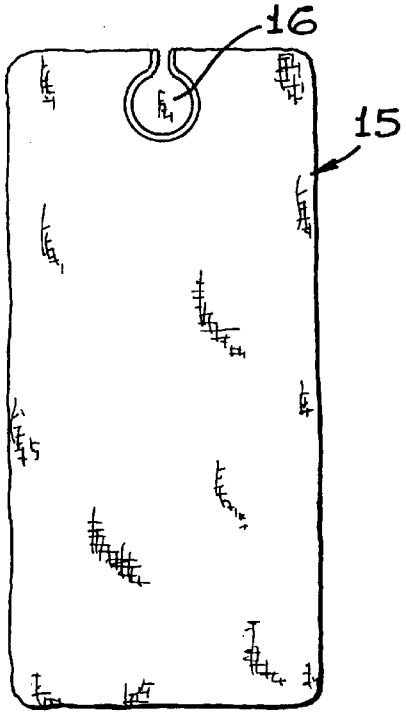
FIG. 6
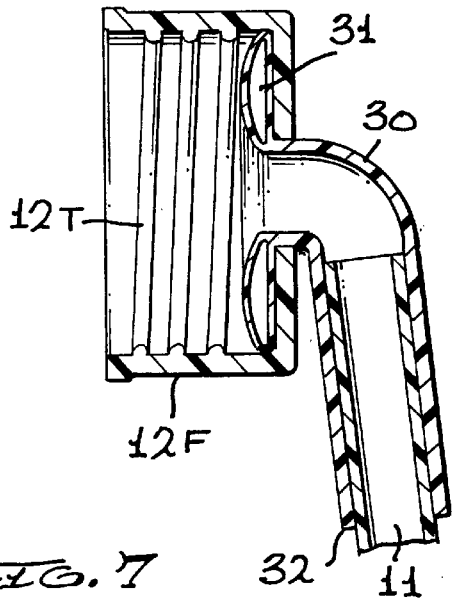
FIG. 7
PRIOR ART
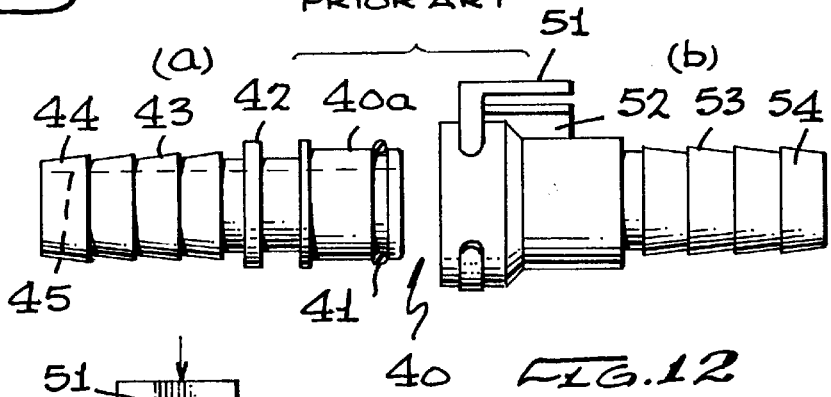
FIG. 8
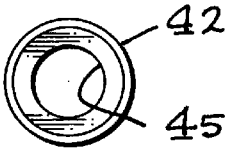
FIG. 9
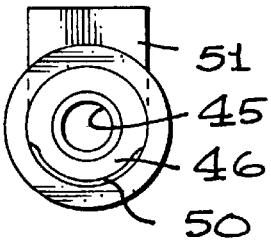
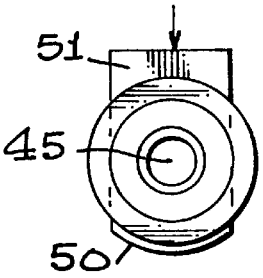
FIG. 10
FIG. 12
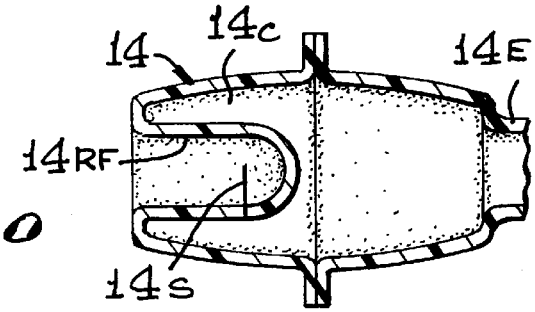
FIG. 11
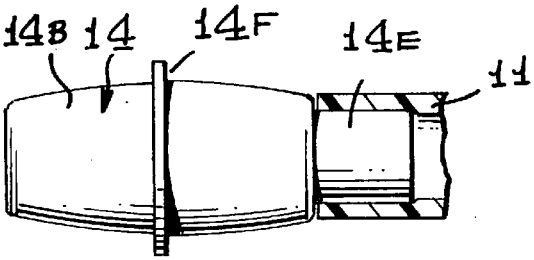
FIG. 13
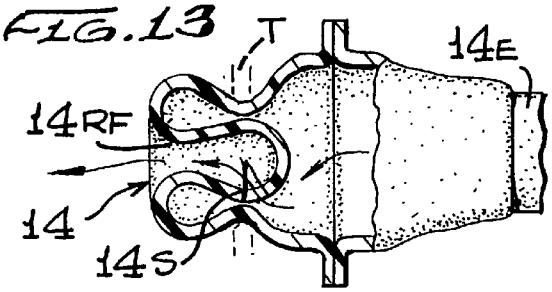

HYDRATION SYSTEM

REFERENCE TO RELATED APPLICATIONS

This application claims the benefit of U.S. Provisional Application No. 60/002,221, now abandoned.

This application is a non provisional application based upon and claims benefit of U.S. Provisional Application No. 60/002,221 filed Aug. 11, 1995, now abandoned.

BACKGROUND OF THE INVENTION

Although the need for water consumption by athletes during exertion is well recognized, there is a continuing need in potable water delivery system for athletes. Systems are needed which allow the athlete to receive water in their mouth on demand without the use of his hands.

Hikers and mountain climbers have a particular need since they are often exposed to dehydrating sun exposure or high altitudes. Often their safety requires unencumbered hands and arms.

Faced with this need, I have developed a hydration system particularly designed for hikers or backpackers but equally useful for others, as well.

BRIEF DESCRIPTION OF THE INVENTION

This invention includes a number of features in an effective hydration system for backpackers and other athletes in need of hands free hydration. The features include:

The combination of a bladder and cover in which the bladder is of larger volume than the cover so that any inadvertent overfilling of the bladder will put rupture load on the cover well before the bladder is in danger of rupture.

The system also includes two filling points, one with a garden hose size male fitting in the dispensing lines and another with a quick release fitting to allow filling from other sources over a flexible line.

An improved simple bite valve is present which can be operated merely by biting down from any orientation while in the hiker's mouth.

The bite valve also includes an annular flange which helps to retain the valve in the user's mouth and aids in supporting the delivery orifice away from contamination if the line and valve are dropped.

Most importantly, the bite valve effectively shuts off unwanted leakage since the slit in the bite valve is oriented perpendicular to the direction of water flow thereby further closing the valve in the presence of pressure from the bladder.

The mating closure for the male fitting on the bladder includes a freely swiveling and effective seal joining the bladder to the dispensing line to the user.

The quick release fitting allows the insertion of other useful equipment such as:

a) an inline filter;

b) a "Y" connection to a second line serving a second person; or c) a line to a mister or a shower head.

BRIEF DESCRIPTION OF THE DRAWING

This invention may be more clearly understood with the following detailed description and by reference to the drawings in which:

FIG. 5 is a front elevational view of the cover of the hydration system;

FIG. 6 is a diametrical sectional view of the outlet connection and the portion of the feed tube of the hydration system of FIG. 2;

FIG. 7 is a side elevational view of a known quick disconnect coupler of FIG. 2;

FIG. 8 is an inlet end view of the male portion (a) of the quick disconnect coupler of FIG. 7;

FIG. 9 is an end elevational view of the outlet end (b) of the quick disconnect of FIG. 7;

FIG. 10 an outlet end elevational view of the part (b) of the disconnect valve of FIG. 7 similar to FIG. 9 with the release button pressed;

FIG. 11 a side elevational view of the mouth valve of the system of FIG. 2;

FIG. 12 is a diametrical sectional view of the valve of FIG. 11;

FIG. 13 is a diametrical view of the mouth valve of FIGS. 11 and 12 in a water flow-through condition as a result of being compressed by the hiker's jaw and teeth;

DETAILED DESCRIPTION OF THE INVENTION

Figure 1:
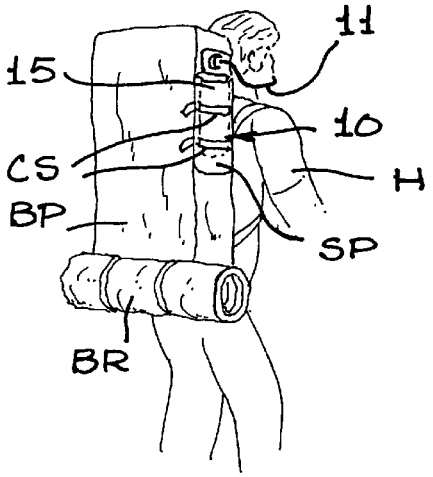
FIG. 1 is a perspective view of a hiker with a backpack showing the hydration system of this invention in a side pocket.
Figure 2:
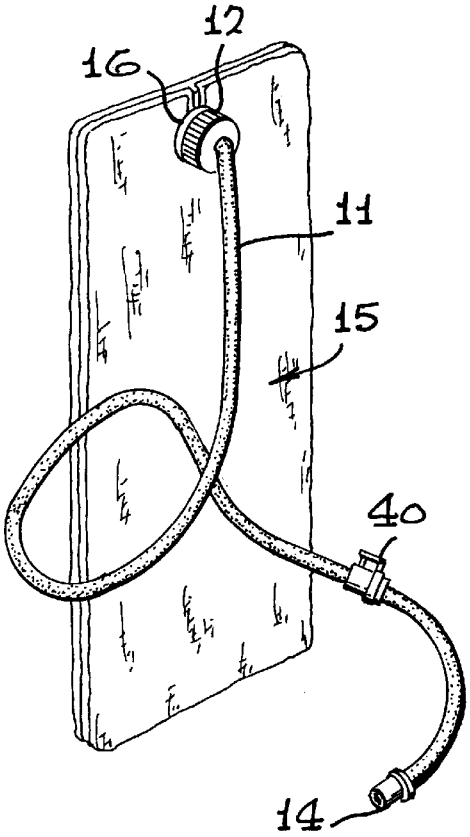
FIG. 2 is a perspective view of the hydration system removed from the backpack.

Referring now to FIG. 1 in connection with FIG. 2, a hiker H is shown carrying a backpack BP and bedroll BR in a typical hiking scene. The backpack BP has a side pocket SP with an open top or at least an accessible top, and in that open top is a hydration system of this invention, generally designated 10, and shown more clearly in FIG. 2. The hydration system has a tube 11 which extends from an outlet 12 through a quick disconnect valve 40 to a jaw actuated valve 14. The hiker H will normally hike with the tube 11 extending out of the pocket and extending over his shoulder and into his mouth to obtain water at any time while hiking without the use of his hands, merely by compressing his teeth about the flexible valve 14 at the outer end of tube 11. If the hydration system 10 is located above his mouth, he has the benefit of gravity flow. Otherwise, a sucking action or slight pressure applied to the exterior of the bag, either by body movement or his arm will produce flow to his mouth. Compression straps CS shown in FIG. 1 on the side of the backpack BP can be drawn up by the wearer and apply positive pressure to the bladder.

Figure 3:
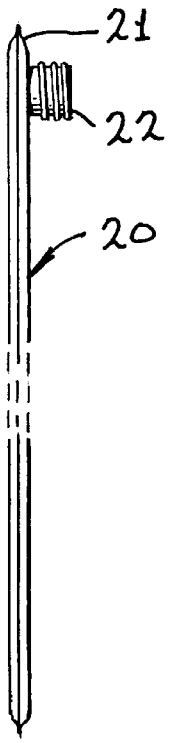
FIG. 3 is a side elevational view of the bladder of the hydration system.
Figure 4:
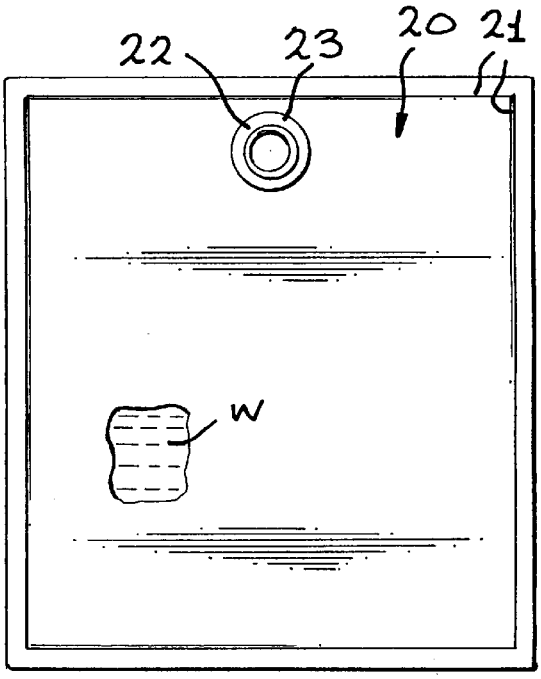
FIG. 4 is a front elevational view of the bladder of FIG. 3.

Referring again to specifically FIG. 2, but now in connection with FIG. 3–5, the hydration system 10 may be seen as including a cover 15 of ripstop nylon or other commonly used backpack materials in an elongated shape suitable for carrying in side pockets or by straps of conventional packpacks. The cover 15 of FIGS. 2 and 5 is sewn closed except for a mouth opening 16 which is slightly larger than the outlet connection 12. Contained within the cover 15 is a bladder 20 of FIGS. 3 and 4 which is typically of aluminized polyester with a polyethylene lining and protective exterior coating or other flexible plastic material and includes edge sealing 21 and an outlet fitting 22 secured by heat sealed ring 23 to the top center of the bladder 20. Outlet fitting 22 has a normal garden hose fitting male thread. The bladder 20, when empty, is quite thin as is apparent in FIG. 3 and somewhat wider and larger in volume than the cover 15 but is designed to be filled to fully expand the cover 15 as is apparent in FIG. 1. The bladder 20 is easily folded to be slipped through the opening 16 of FIG. 5 and when filled expands to fully utilize the cover 15 volume. The oversize bladder 20 as compared with the size and volume of cover 15 means that any unintentional overfilling will result in stress and possible bursting of the easily replaced cover 15 rather than the bladder 20.

The operational components of the water delivery system are shown in FIGS. 6–13. They include the outlet female connector 12F with internal threads 12T and a rotatable elbow 30 having an internal compression seal 31 and an outlet 32 which is sealed as with adhesive to the inlet end of flexible tubing 11. Compression seal 31 is a soft plastic material such as polyvinylchloride which provides an effective water seal while allowing rotation of the elbow 30 in cap 12F. The free 360° rotation of the elbow 30 and seal 31 in the female connector when slightly loosened allows the user to aim the delivery tubing 11 in any desired direction followed by tightening of the connector 12F for effective sealing.

At an intermediate point in the length of the tubing 11 is a quick disconnect valve 40 of FIG. 7 including a male part 40*a*, a sealing O ring 41 and female part 40*b* with an end stop disc 42 as well as conventional reverse barbs 43 and entrance inlet portion 44 for securement with flexible tube 11. Both parts 40*a* and 40*b* have a central through opening 45 best seen in FIGS. 8–10.

The quick disconnect portion 40*b* includes a recess 46 which is partially obstructed by a locking crescent 50 controlled by a spring loaded release handle 51 shown in its unoperated position B and its operated position in FIG. 10. Similar barbs 53 and inlet 54 allow the quick disconnect coupling to be inserted in the adjacent end of tubing 11. The reason for the quick disconnect element 40 in the line 11 is to allow direct filling of the bladder 20 while in the cover 15 without even the removal from the backpack side pocket, merely by separating the two parts of the hose 11 and inserting the end of the hose into a stream of water from a faucet or other source to allow filling of the bladder 20.

The presence of the quick disconnected valve 40 also allows the mouth valve to be removed providing for the substitution of new mouth valves, multiple heads through a T joint and tubing, shower heads or mister sprays as the owner desires.

If an inline filter is intended to be used in connection with this hydration system, it is possible through the use of a second quick disconnect valve 40 such as shown in FIG. 7, inserted between the filter and the present quick disconnect valve. In this manner the hydration system may be used with any filter system which the hiker may already own or purchases. The quick disconnect operation is accomplished merely by pressing the lever 51 in the direction of the arrow in FIG. 10 which causes its integral spring 52 to be depressed and the crescent 50 moves out of place as shown in FIG. 10 and the disk 42 is free to exit the recess 46.

Of prime importance to the hiker is the valve 14 of FIGS. 11–13. It is of transparent flexible transparent material such as polyvinylchloride with a bulbous portion 14B, having an integral ring 14F which acts as a retention device in the mouth and a tube end 14E which slips into the tube 11. The end 14E is preferably secured as by an adhesive to the tube 11. The bulbous portion 14B has a separator between the ports of the bite valve 14 including reverse fold 14RF which defines a recess including a slit 14S in the side wall. The cavity 14C within the mouth valve 14 is normally filled with potable water. When the user compresses the mouth valve 14, in almost any direction of origination within his mouth, the slit 14S of FIGS. 12 and 13 opens and a flow of water is possible in the direction of arrows of FIG. 13 into the hiker's mouth. As soon as he relaxes the pressure of his teeth on the mouth valve 14, it returns to the shape of FIGS. 11 and 12 and flow stops. If he takes the valve out of his mouth, the valve 14 and the slit 14S remain closed and the tube 11 does not leak. The slit 14S is oriented perpendicular to the direction of water flow thereby closing the mouth valve tighter with more pressure.

Figure 14:
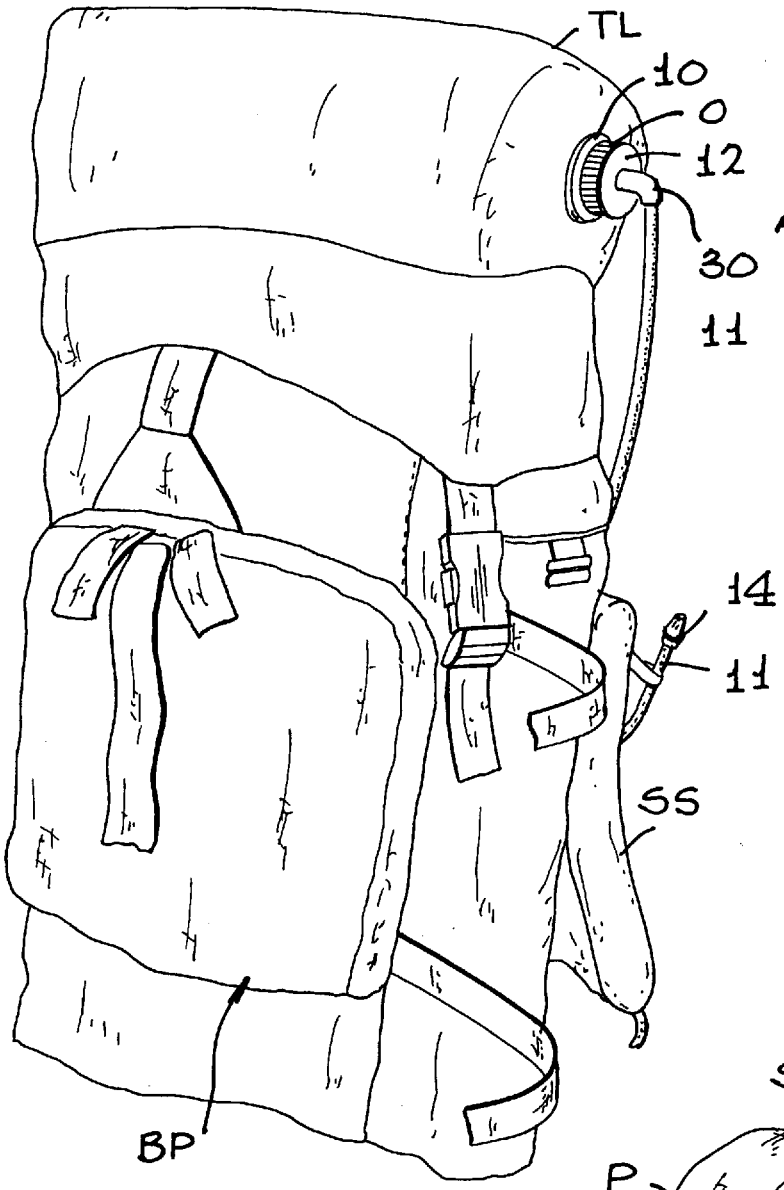
FIG. 14 is a fragmentary perspective view of a full size backpack with the hydration system of this invention carried at the top of the pack.
Figure 15:
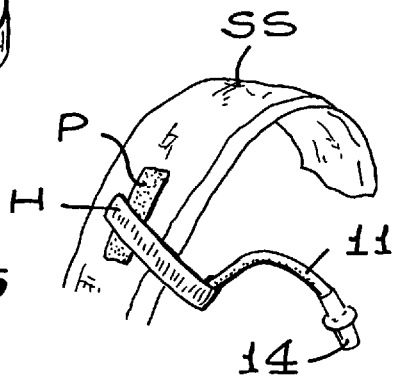
FIG. 15 is a fragmentary perspective view of the shoulder strap of the backpack of FIG. 14 with the mouth or bite valve held to the outer surface of the strap by hook and pile attachment.

FIGS. 14 and 15 show an alternate way of carrying this hydration system on the top of a backpack with the mouth valve carried conveniently and under clean conditions.

In FIG. 14 backpack BP has as top cover TC with an opening O or flap which allows the hydration system 10 to be secured and covered while allowing the outlet 12, elbow 30, and tube 11 of the hydration system 10 to exit from the pack. The top location insures gravity feed of potable water to the hiker.

As shown in FIG. 15, a loop of hook fabric fastener H encircles the tubing 11 a few inches from the mouth valve 14. The hook fastener H mates with the conventional pile fabric commonly found on the outer surfaces of shoulder straps SS of backpacks BP such as the DENALI backpack of Gregory Mountain Products division of Bianchi International, assignee of this invention. For packs which are not already equipped with pile fasteners at the appropriate location, a small strip of that material P may be adhesively secured to the shoulder strap or other convenient location selected by the hiker.

The mouth valve 14 is secured at chest or chin height by the fabric fastener H ready for hydration at any time.

This system allows the easily filling, easy storing, easy using hydration system for hikers or other persons who need the flow of water while performing operations or activities in which they are required or desire to use their hands for other purposes.

The above described embodiments of the present invention are merely descriptive of its principles and are not to be considered limiting. The scope of the present invention instead shall be determined from the scope of the following claims including their equivalents.

What is claimed is:

1. A personal hydration system for carrying potable water for hands free delivery of fluid to a user's mouth while physically active comprising:

a bladder for holding potable fluid;

a cover for supporting said bladder with an opening therein for access to said bladder;

a line connected to said bladder for delivery of potable fluid;

a mouth pressure deformable valve connected to said line dimensioned to fit into a person's mouth;

said pressure deformable valve including an inlet port, an outlet port and a separator including a reverse fold separating the inlet port from the outlet port;

said reverse fold including a slit therein extending substantially perpendicular to the direction of flow between the inlet port and the outlet port of said valve whereby deformation of said deformable valve opens the slit in said separator; and whereby pressure at the inlet port from the bladder tends to close the slit.

2. A personal hydration system in accordance with claim 1 wherein said valve includes an integral ring which acts as a retention device in the user's mouth.

3. A personal hydration system in accordance with claim 1 wherein said bladder is oversized as compared with the cover whereby upon overfilling, the cover will be subject to bursting stress before the bladder.

4. A personal hydration system in accordance with claim 1 including a quick disconnect fitting in said line between said bladder and said pressure deformable valve.

5. A personal hydration system in accordance with claim 1 including a standard hose fitting between said bladder and said valve.

6. A personal hydration system in accordance with claim 1 including an openable connection between said bladder and said line and further including a 360° pivotal elbow in said connection.

7. A personal hydration system in accordance with claim 6 including a quick disconnect fitting in said line.

8. A personal hydration system in accordance with claim 6 including a standard hose fitting between said bladder and said valve.

* * * * *